US010563337B2

(12) United States Patent
Joo et al.

(10) Patent No.: US 10,563,337 B2
(45) Date of Patent: Feb. 18, 2020

(54) WALL-MOUNTED DRUM WASHING MACHINE

(71) Applicant: Dongbu Daewoo Electronics Corporation, Seoul (KR)

(72) Inventors: Sung Su Joo, Seoul (KR); Dae Hyun Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 1173 days.

(21) Appl. No.: 14/080,692

(22) Filed: Nov. 14, 2013

(65) Prior Publication Data

US 2014/0159556 A1 Jun. 12, 2014
US 2017/0298557 A9 Oct. 19, 2017

(30) Foreign Application Priority Data

Dec. 7, 2012 (KR) ..... 10-2012-0141937
Dec. 27, 2012 (KR) ..... 10-2012-0154996

(51) Int. Cl.
*D06F 37/22* (2006.01)
*D06F 37/26* (2006.01)
*D06F 39/12* (2006.01)

(52) U.S. Cl.
CPC ..... *D06F 37/22* (2013.01); *D06F 37/267* (2013.01); *D06F 39/12* (2013.01); *D06F 37/264* (2013.01)

(58) Field of Classification Search
CPC ..... D06F 37/20; D06F 37/22; D06F 39/12; D06F 39/125; D06F 39/001; D06F 37/264; D06F 37/267; Y10T 403/72; E04G 5/04
See application file for complete search history.

(56) References Cited

U.S. PATENT DOCUMENTS 3,605,456 A * 9/1971 Klimboff ..... D06F 1/00 4/640
6,460,382 B1 * 10/2002 Kim ..... D06F 37/304 68/140
9,435,065 B2 * 9/2016 Favaro ..... D06F 39/12
2007/0262213 A1 * 11/2007 de Toledo ..... A47L 15/4253 248/188.8
2011/0067459 A1 * 3/2011 Gracia Bobed ..... D06F 37/20 68/212
2012/0194047 A1 * 8/2012 Kiechle ..... A47L 15/427 312/228
2013/0026895 A1 * 1/2013 Gweon ..... D06F 37/265 312/228
2013/0305789 A1 * 11/2013 Sul ..... D06F 37/264 68/139
2013/0313385 A1 * 11/2013 Mora ..... F16M 7/00 248/188.4

FOREIGN PATENT DOCUMENTS

CN 202247393 5/2012
EP 1498537 A1 * 1/2005 ..... D06F 39/001
(Continued)

OTHER PUBLICATIONS

CN202247393—Machine Translation, May 2012.*
(Continued)

*Primary Examiner* — Marc Lorenzi

(57) ABSTRACT

A wall-mounted drum washing machine includes a housing having one or more through-holes in a rear surface thereof; and one or more fixing units having a first side or end fixed to a wall and a second side or end inserted in one of the through-hole(s), wherein each through-hole includes a guide having a cross-sectional area that decreases from a rear surface of the housing toward a front of the housing.

5 Claims, 19 Drawing Sheets

(56) References Cited

FOREIGN PATENT DOCUMENTS

| | | | | | |
|---|---|---|---|---|---|
| EP | 2216582 | | | 8/2010 | |
| EP | 2317001 | | | 5/2011 | |
| EP | 2594686 | | | 5/2013 | |
| KR | 20-0305578 | | | 2/2003 | |
| KR | 20040011965 | A | * | 2/2004 | |
| KR | 20060032321 | A | * | 4/2006 | |
| KR | 2006-0125298 | | | 12/2006 | |
| WO | WO-2005066408 | A1 | * | 7/2005 | ..... D06F 39/001 |
| WO | WO 2008104478 | A1 | * | 9/2008 | ..... D06F 39/001 |
| WO | WO-2010076134 | A1 | * | 7/2010 | ..... D06F 39/001 |

OTHER PUBLICATIONS

WO2008104478—Machine Translation, Sep. 2008.*
KR20060032321—Machine Translation, Apr. 2006.*
EP1498537—Machine Translation (Year: 2005).*
KR20040011965—Machine Translation (Year: 2004).*
Qianping Wang, Espacenet Bibliographic Data: Abstract of CN202247393, May 30, 2012, 1 page, European Patent Office, http://worldwide.espacenet.com.
Choo Sung Youp, Espacenet Bibliographic Data: Abstract of KR20060125298, Dec. 6, 2006, 1 page, European Patent Office, http://worldwide.espacenet.com.
Sung Gon Kim, et al., KIPRIS Bibliographic Data: Abstract of Korean Patent Reg. No. 2003055780000, Published Feb. 26, 2003; Korean Intellectual Property Office, http://engpat.kipris.or.kr.

* cited by examiner

WALL-MOUNTED DRUM WASHING MACHINE

CROSS-REFERENCES TO RELATED APPLICATIONS

The present application claims priority to Korean application number 10-2012-0141937, filed on Dec. 7, 2012, and Korean application number 10-2012-0154996, filed on Dec. 7, 2012, which are incorporated by reference herein in their entireties.

BACKGROUND OF THE INVENTION

The present invention relates to a wall-mounted drum washing machine, and more particularly, to a wall-mounted drum washing machine which includes a buffer between a rear surface of the housing and a wall surface. The present invention prevents vibrations generated during a washing operation from being transmitted to the wall surface.

A general wall-mounted drum washing machine includes a cabinet, a movable tub in the cabinet for containing water, a rotatable drum in the tub for housing laundry items, a driving unit configured to provide power to the drum, a water supply device configured to supply wash water to the tub, and a drain device configured to discharge wash water from the tub to outside of the cabinet.

When a user places laundry items into the drum and starts a washing operation, the water supply device supplies wash water into the tub and the drum. A washing process starts as the driving unit rotates the drum.

After the washing process has ended, the wash water contained in the tub and the drum is discharged outside of the cabinet through the drain device.

The related art of the present invention has been disclosed in Utility Model Registration Notification No. 20-0305578, published on Feb. 26, 2003, and titled "Wall-mounted small drum washing machine."

The conventional wall-mounted drum washing machine includes a housing that forms an exterior section of the washing machine, having a plurality of sections that are fastened to a wall surface. As a result, securing the housing to the wall at a precise position may be time consuming.

Furthermore, the vibrations generated during a washing operation may be transmitted to the wall surface, causing noise.

Thus, there is a demand for a structure capable of solving such problems.

SUMMARY OF THE INVENTION

Embodiments of the present invention are directed to a wall-mounted drum washing machine which includes a through-hole in a rear surface of a housing configured to guide insertion of one or more fastening or fixing units to a precise position, thereby facilitating a connection between the housing and the fastening or fixing unit(s).

Embodiments of the present invention are particularly directed to a wall-mounted drum washing machine which includes a housing having a rear surface, a buffer between the rear surface of the housing and a wall surface, and one or more fastening or fixing units configured to pass through the rear surface of the housing, thereby reducing or preventing transmission of vibrations to the wall.

In one or more embodiments, a wall-mounted drum washing machine includes a housing having a through-hole in a rear surface thereof; and one or more fastening or fixing units having a first side or end fixed to a wall and a second side or end in the through-hole, wherein the through-hole includes a guide having a cross-sectional area that decreases from the rear surface of the housing to a front of the housing.

The through-hole may include an insertion opening continuous and/or in communication with a front end of the guide, wherein the fastening or fixing unit(s) is configured to be through the insertion opening.

An insertion opening may be aligned with a center of the guide.

In other embodiment(s), a wall-mounted drum washing machine includes a housing having a through-hole in a rear surface thereof; one or more fastening or fixing units having a first side or end fixed to a wall and a second side or end in the through-hole; and a buffer configured to be between the wall surface and the rear surface wherein the fastening or fixing unit(s) are configured to pass through the buffer, and the through-hole includes a guide having a cross-sectional area that decreases from the rear surface of the housing toward a front of the housing.

The through-hole may include an insertion opening continuous and/or communication with a front end of the guide, wherein the fastening or fixing unit(s) is configured to be through the insertion opening.

The insertion opening may be aligned with a center of the guide.

An outer surface of the buffer may be attached to or in contact with an inner surface of the guide when the buffer is coupled to the fastening or fixing unit(s).

In yet other embodiment(s), a wall-mounted drum washing machine includes a housing having a through-hole in a rear surface thereof; a buffer in the through-hole configured to be between the rear surface and a wall; and one or more fastening or fixing units having a first side or end fixed to the wall and a second side or end in the through-hole.

The buffer may include a pad between the rear surface and the wall surface; and one or more boss portions configured to protrude or extend from the pad and through the through-hole, wherein the through-hole has an inner surface with a shape corresponding to an outer surface of the boss portion.

The boss portion may have a plurality of protrusions or projections on an outer surface thereof, and the through-hole may have a plurality of grooves in the inner surface thereof, having a shape corresponding to the protrusions or projections.

The plurality of protrusions or projections may be at even intervals on the outer surface of the boss portion, and the plurality of grooves may be at positions corresponding to the protrusions or projections.

The center of the through-hole may be aligned with the center of the boss portion.

DETAILED DESCRIPTION

Embodiments of the invention will hereinafter be described in detail with reference to the accompanying drawings. It should be noted that the drawings are not necessarily to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
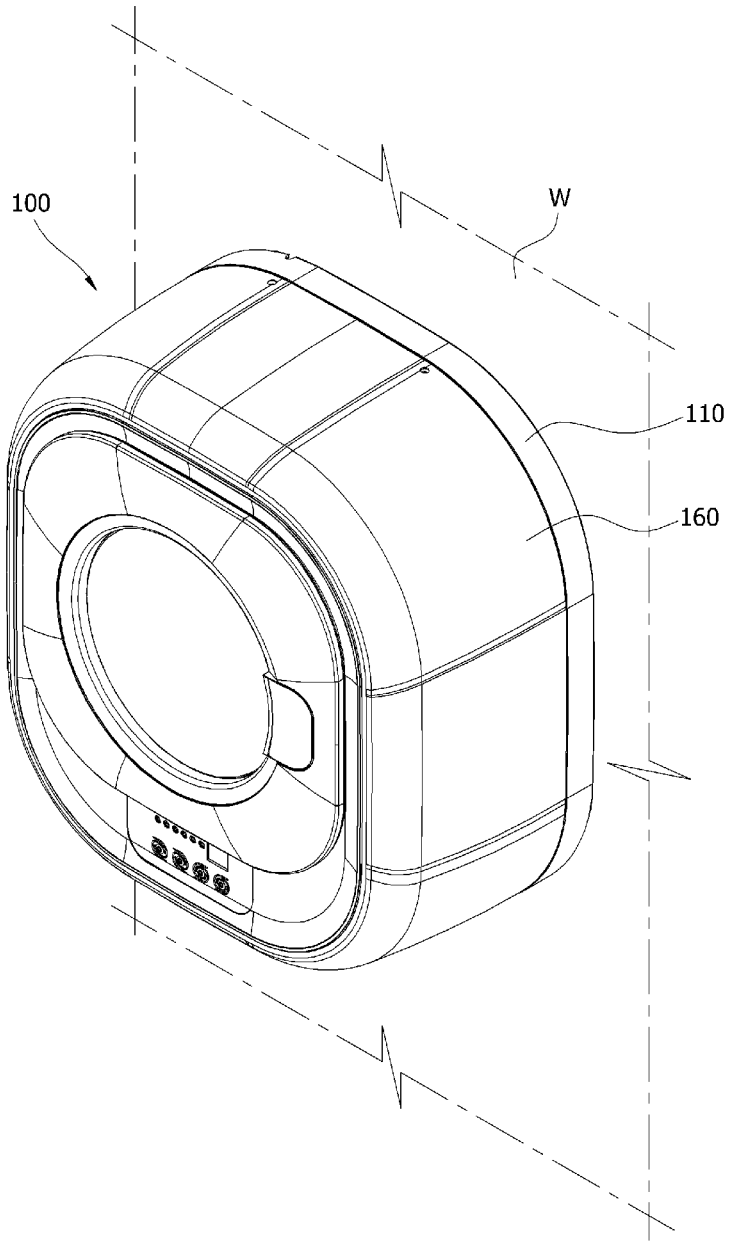
FIG. 1 is a perspective view illustrating an exemplary wall-mounted drum washing machine in accordance with embodiment(s) of the present invention, installed on a wall surface.
Figure 2:
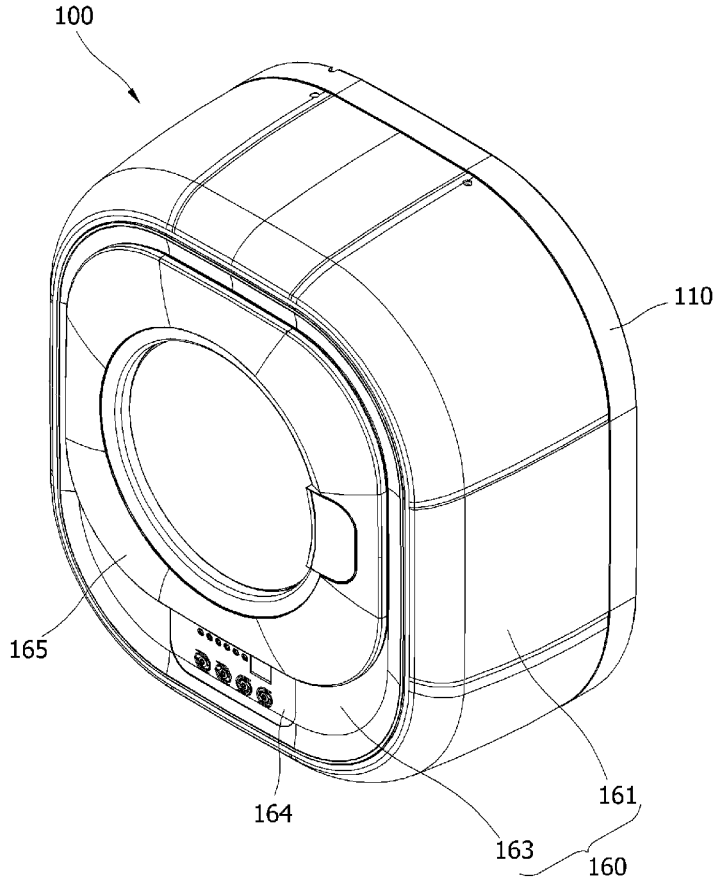
FIG. 2 is a front perspective view of the exemplary wall-mounted drum washing machine in accordance with embodiment(s) of the present invention.
Figure 3:
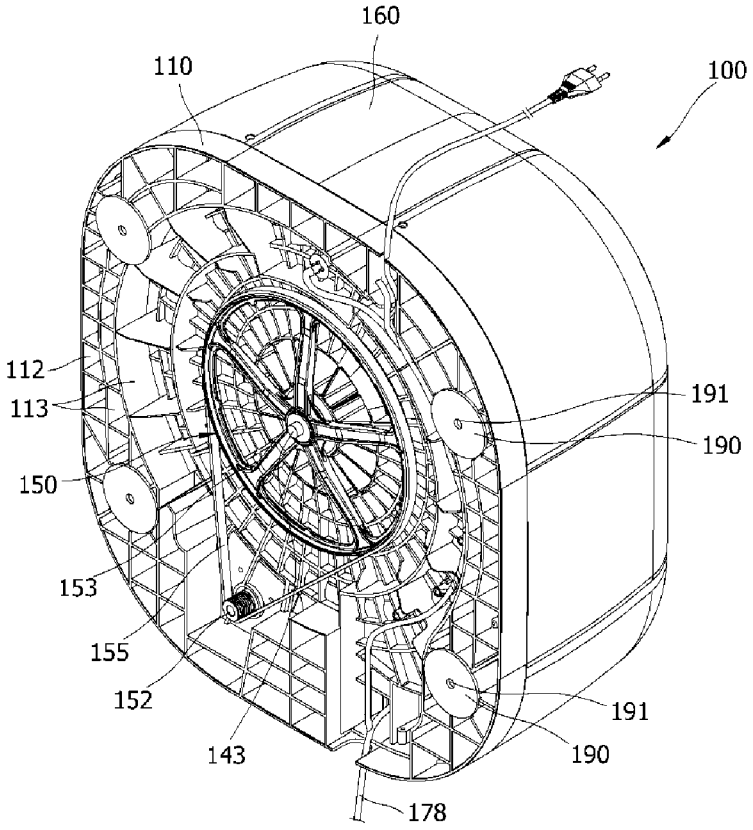
FIG. 3 is a rear perspective view of the exemplary wall-mounted drum washing machine in accordance with embodiment(s) of the present invention.
Figure 4:
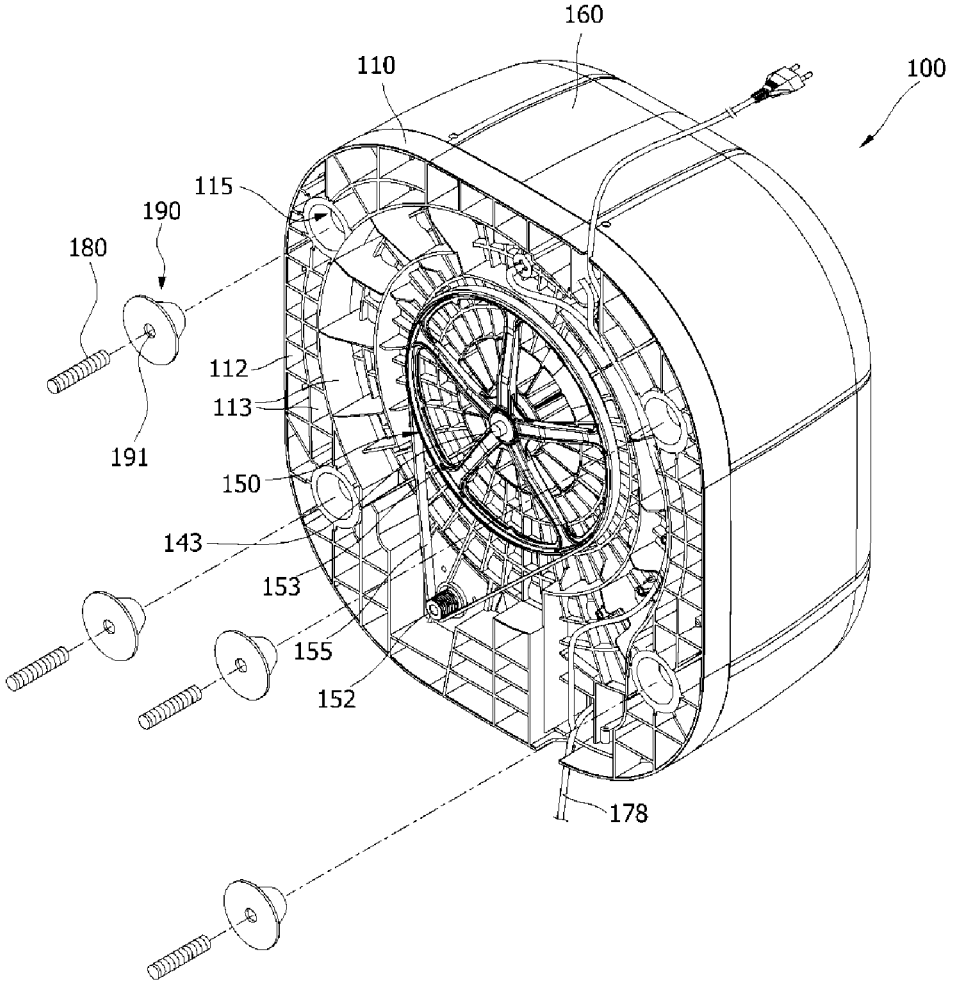
FIG. 4 is a perspective view illustrating exemplary buffers separated from a rear panel in the wall-mounted drum washing machine in accordance with embodiment(s) of the present invention.
Figure 5:
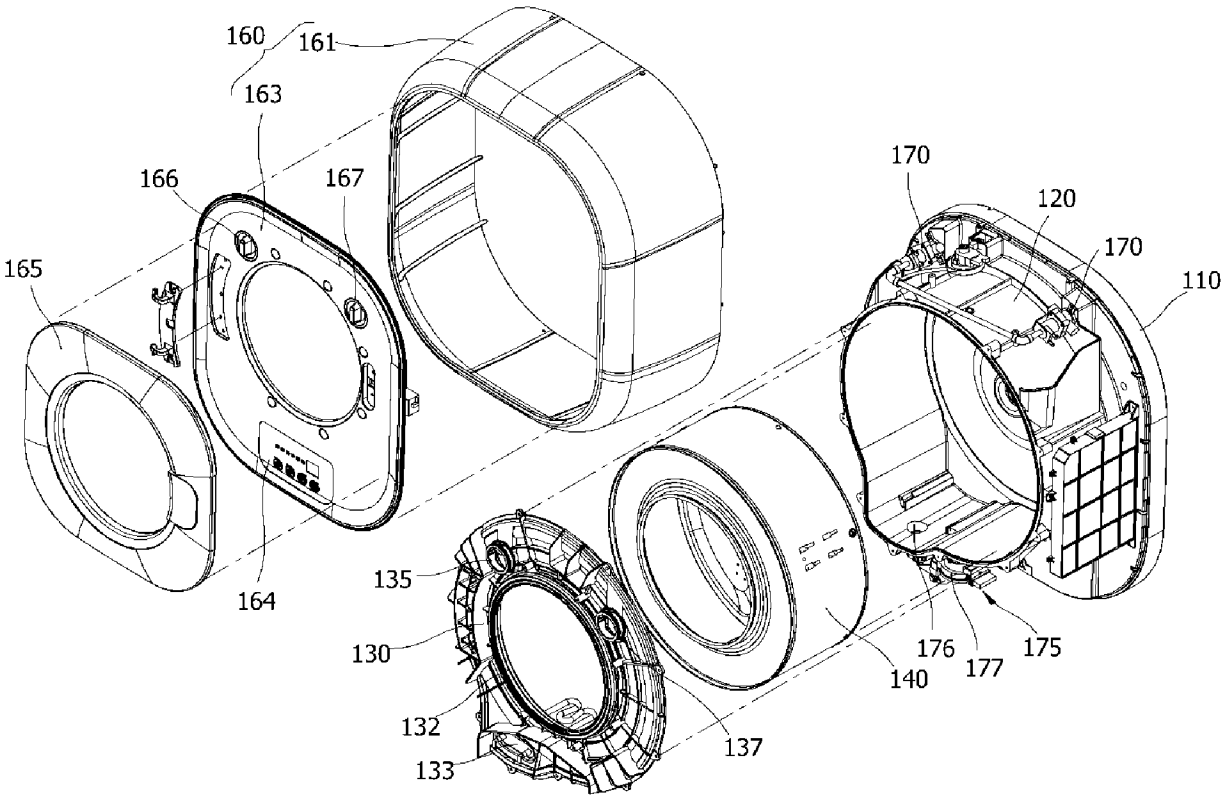
FIG. 5 is an exploded perspective view of the exemplary wall-mounted drum washing machine in accordance with embodiment(s) of the present invention.
Figure 6:
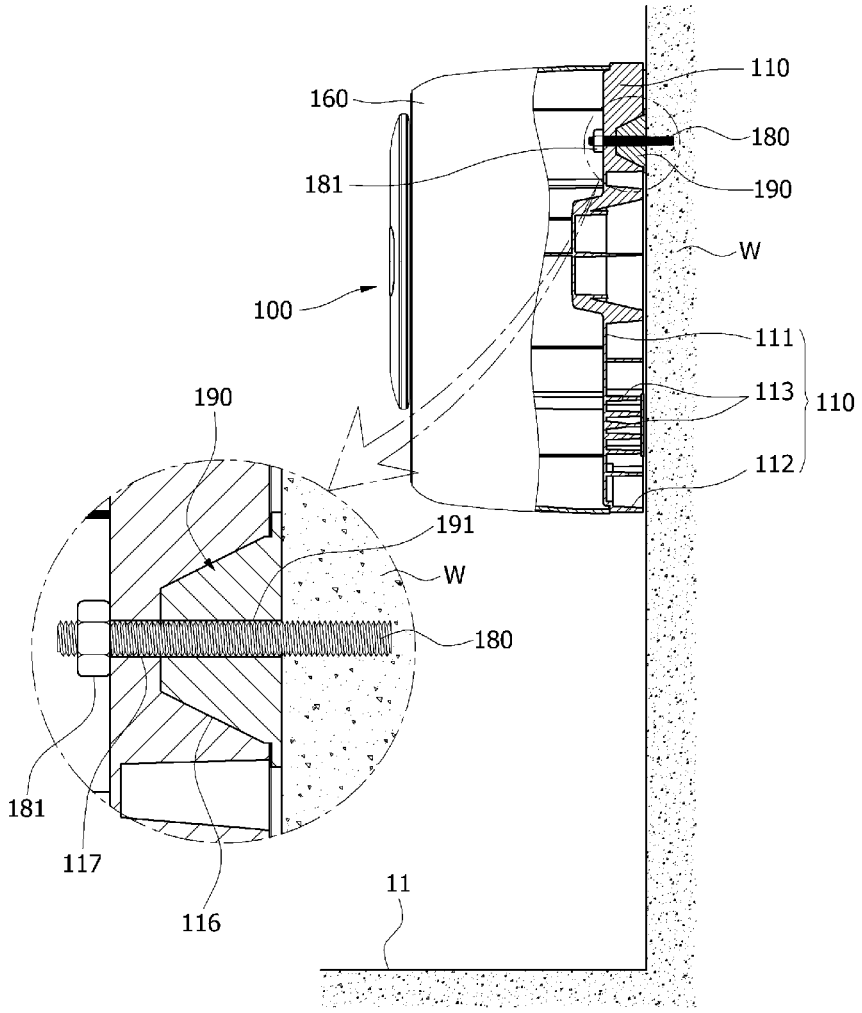
FIG. 6 is a partial side cross-sectional view of the exemplary wall-mounted drum washing machine in accordance with embodiment(s) of the present invention.
Figure 7:
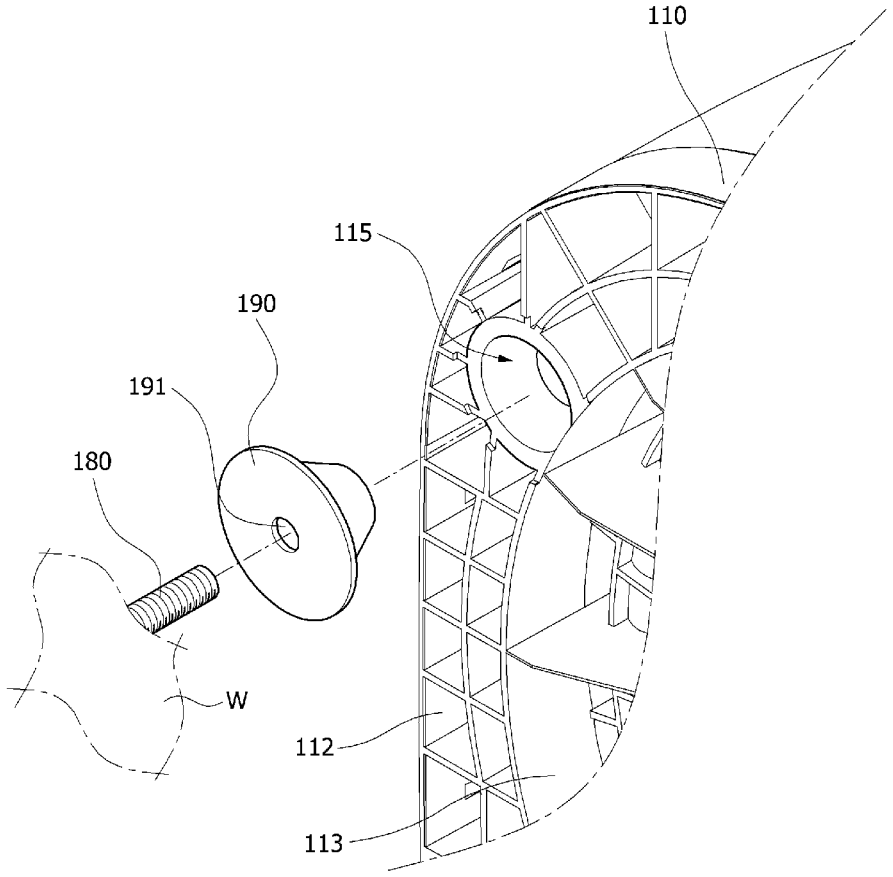
FIG. 7 is an exploded perspective view illustrating the exemplary rear panel, the buffer, and a fastening or fixing unit in the wall-mounted drum washing machine in accordance with embodiment(s) of the present invention.
Figure 8:
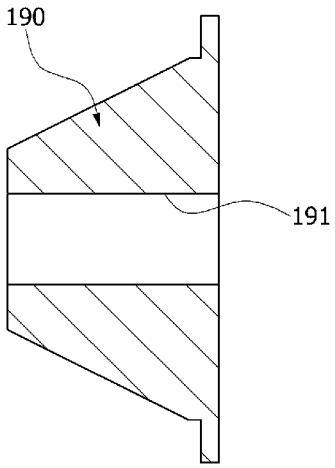
FIG. 8 is a cross-sectional view of an exemplary buffer for a wall-mounted drum washing machine in accordance with embodiment(s) of the present invention.
Figure 9:
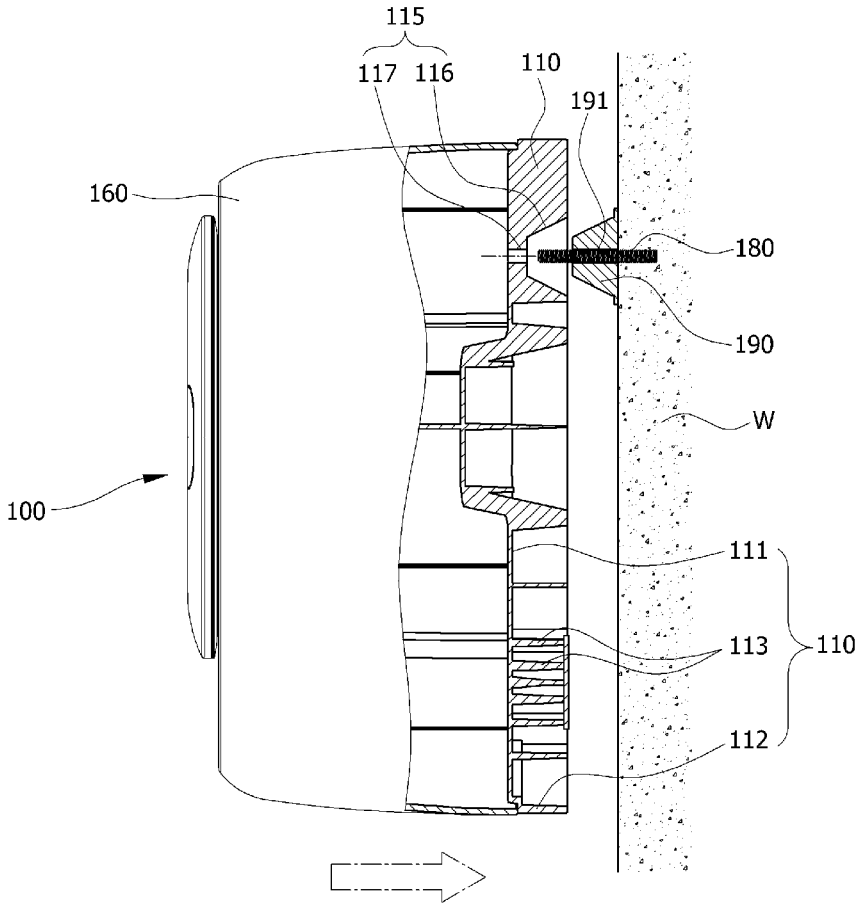
FIG. 9 is a diagram illustrating the exemplary rear panel positioned close to the fastening or fixing unit(s) in the wall-mounted drum washing machine in accordance with embodiment(s) of the present invention.

FIG. 1 is a perspective view illustrating an exemplary wall-mounted drum washing machine in accordance with embodiment(s) of the present invention, installed on a wall surface. FIG. 2 is a front perspective view of the exemplary wall-mounted drum washing machine in accordance with embodiment(s) of the present invention. FIG. 3 is a rear perspective view of the exemplary wall-mounted drum washing machine in accordance with embodiment(s) of the present invention. FIG. 4 is a perspective view illustrating exemplary buffers unit separated from a rear panel in the wall-mounted drum washing machine in accordance with embodiment(s) of the present invention. FIG. 5 is an exploded perspective view of the exemplary wall-mounted drum washing machine in accordance with embodiment(s) of the present invention. FIG. 6 is a partial side cross-sectional view of the exemplary wall-mounted drum washing machine in accordance with embodiment(s) of the present invention. FIG. 7 is an exploded perspective view illustrating the exemplary rear panel, the buffer, and a fastening or fixing unit in the wall-mounted drum washing machine in accordance with embodiment(s) of the present invention. FIG. 8 is a cross-sectional view of an exemplary buffer for a wall-mounted drum washing machine in accordance with embodiment(s) of the present invention. FIG. 9 is a diagram illustrating the exemplary rear panel positioned close to the fastening or fixing unit(s) in the wall-mounted drum washing machine in accordance with embodiment(s) of the present invention.

Referring to FIGS. 1 to 6, the wall-mounted drum washing machine 100 in accordance with embodiment(s) of the present invention includes a rear panel 110, a tub 120, a front panel 130, a drum 140, a driving unit 150, a cover 160, a water supply device 170, a drain device 175, a fastening or fixing unit 180 (e.g., a screw, a bolt, an angle bolt, an anchor, or the like), and a buffer 190.

The rear panel 110 may have a panel shape and be mounted, installed or fixed on a wall W. In the present embodiment(s), the rear panel 110 may have a square or rectangular shape, which may have rounded corners, but is not limited thereto. The rear panel 110 may have any of various shapes, such as circular or elliptical.

The rear panel 110 includes a panel portion 111, a circumference 112, and one or more ribs 113.

The panel portion 111 has a panel shape (e.g., a substantially flat, substantially square or rectangular shape) extending parallel to the surface of the wall W.

The circumference 112 protrudes or extends from the edge or periphery of the panel portion 111 toward the wall surface W, forming a space between the periphery of the panel portion 111 and the wall surface W.

The rib(s) 113 on a rear surface of the panel portion 111 also form a space between the panel portion 111 and the wall surface W.

Since the rear panel 110 is reinforced by the ribs 113, deformation, damage, or breakage of or to the rear panel 110 due to vibrations generated by rotations of the drum 140 may be reduced or prevented.

An exterior part of the wall-mounted drum washing machine 100 may be referred to as a housing. Thus, the rear panel 110 forming a rear surface of the wall-mounted drum washing machine 100, a cover 160 forming side surfaces, and a front surface of the wall-mounted drum washing machine 100 are collectively referred to as the housing.

In the present embodiment(s), the rear surface of the housing and/or the rear panel 110 has a through-hole 115 through which the fastening or fixing unit(s) 180 are inserted to be coupled to the wall W.

A first side or end of the fixing unit(s) 180 are attached or fixed to the wall W, and a second (opposite) side or end of the fastening or fixing unit(s) 180 are in the through-hole 115. In the present embodiment(s), the rear panel 110 may be square or rectangular, or a panel shape similar to the rectangular shape when seen from the front, and has through-holes 115 in the four corners. Thus, the wall-mounted drum washing machine 100 includes four fastening or fixing units 180 configured to be inserted into the through-holes 115.

Referring to FIGS. 6 to 9, the through-hole 115 includes a guide 116 and an insertion opening 117. The guide 116 has a cross-sectional area that decreases from the rear surface of the rear panel 110 toward the front side of the rear panel 110. The fastening or fixing unit(s) 180 passes through the insertion opening 117 and is continuous with or in communication with a front end of the guide 116.

As such, the guide 116 has a larger diameter than the insertion opening 117. When the rear panel 110 is mounted on or attached to the fastening or fixing unit(s) 180, the fastening or fixing unit(s) 180 are guided by the guide 116 through the insertion opening 117.

Although the vertical and horizontal positions of the fastening or fixing unit(s) 180 and the insertion opening 117 may not precisely correspond with each other, the fastening or fixing unit(s) 180 are guided into the insertion opening 117 through the guide 116. Therefore, an operator may easily insert the fastening or fixing unit(s) 180 into the insertion opening 117, such that the rear panel 110 and the fastening or fixing unit(s) 180 are easily fastened or attached to each other.

The guide 116 has a cross-sectional area that gradually decreases from the rear surface of the rear panel 110 toward the front side of the rear panel 110. As a result, the fastening or fixing unit(s) 180 contact the guide unit 116 and pass through the insertion opening 117 along the inner surface of the guide 116.

In the present embodiment(s), the guide 116 has a circular cross-section. Thus, the fastening or fixing unit(s) 180 are guided into the insertion opening 117 along the guide 116.

The fastening or fixing unit(s) 180 are coupled to the rear panel 110 through the insertion opening 117. When an anchor bolt is applied as the fastening or fixing unit(s) 180, a nut member 181 may be fastened to a front end of the fastening or fixing unit(s) 180 so as to attach the rear panel 110 to the wall surface W. The nut member 181 is screwed, attached or fastened to the fastening or fixing unit(s) 180 at the front side of the rear panel 110, and attached to or in contact with the front surface of the rear panel 110.

The insertion opening 117 is continuous with or in communication with the front end of the guide 116 at the center of the guide 116. Since the insertion opening 117 may be disposed to one side (e.g., upper or lower, or left or right side) of the guide 116, the fixing unit 180 may be guided into the insertion opening 117 through the guide 116.

The wall-mounted drum washing machine 100 in accordance with embodiment(s) of the present invention may additionally include a buffer 190.

The buffer 190 is between the wall surface W and the rear panel 110 having the through-hole 115 formed therein. The fastening or fixing unit(s) 180 are configured to be inserted into or through the insertion opening 117 and configured to pass through a through-hole 191 of the buffer 190.

The vibrations and noise generated during the washing operation are transmitted to the wall surface W through the rear panel 110 in the absence of any buffer or vibration-damping material between the rear panel 110 and the wall surface W. As the buffer 190 is between the rear panel 110 and the wall surface W, it may be possible to significantly reduce the amount of vibrations and noise transmitted to the wall or wall surface W.

The buffer 190 is coupled to the fastening or fixing unit(s) 180 such that the outer surface thereof is attached to or in contact with the inner surface of the guide 116. Specifically, the buffer 190 has a cross-sectional area that decreases from the rear surface of the buffer 190 toward the front of the buffer 190. In at least one of the present embodiments, the buffer 190 has a funnel shape in which the outer diameter decreases from the rear surface toward the front.

Since the buffer 190 is in contact with the guide 116 across an entire inner surface of the guide 116, the contact area between the rear panel 110 and the buffer 190 increases. Thus, the vibrations and noise generated in the housing of the wall-mounted drum washing machine 110 are absorbed through the buffer 190 before being transmitted to the wall surface W.

Furthermore, since the vibrations generated by the drum 140 may be absorbed through the buffer 190, the vibrations and noise generated between the rear panel 110 and the wall surface W may be prevented.

Referring to FIGS. 3 to 6, the tub 120 configured to contain water is supported by the rear panel 110. In the present embodiment(s), the tub 120 has a cylindrical shape, is integral with the rear panel 110, and protrudes or extends from the front surface of the rear panel 110 toward the front of the washing machine.

The drum 140 has a cylindrical shape, is rotatable, is in the tub 120, and is configured to contain laundry items therein. The drum 140 has a rotatable driving shaft 143 in or on the rear panel 110 and connected to a driving unit 150 that is installed on the rear surface of the rear panel 110 through the panel portion 111.

The driving unit 150 provides power to the drum 140. The driving unit 150 in accordance with embodiment(s) of the present invention includes a motor (not illustrated), a driving wheel 153, and a belt 155.

The motor is installed on the front surface of the rear panel 110, and has a rotating shaft 152 that extends to the rear surface of the rear panel 110 through the rear panel 110.

The rotatable driving wheel 153 is in the space between the rear surface of the panel portion 111 and the wall W, and is connected to the driving shaft 143 on the drum 140.

The belt 155 transmits the power of the motor to the driving wheel 153. The belt 155 is around the rotating shaft 152 at one end, and around the driving wheel 153 at another (e.g., opposite) end.

As the motor is driven, the torque of the motor is transmitted to the driving wheel 153 through the belt 155. The drum 140 connected to the driving wheel 153 is rotated to perform a washing operation.

The front panel 130 has an opening 132 at a position corresponding to an opening of the tub 120, and is on the front surface of the tub 120. The front panel 130 includes a control unit 133 installed at the bottom thereof, and a detergent box or drawer 135 and a fabric conditioner box or drawer 137 at the top thereof.

The control unit 133 is continuous with or in communication with a manipulation unit (e.g., operation unit) 164 in a cover portion 163. The control unit 133 controls various processes, such as supplying water, drainage, spin-drying, rotation of the drum 140, and the like according to a manipulation for the manipulation unit 164.

The cover 160 is installed on or over the rear panel 110 to cover the tub 120 and the front panel 130, thereby forming the exterior of the wall-mounted drum washing machine 100 in accordance with embodiment(s) of the present invention.

The cover 160 in accordance with embodiment(s) of the present invention includes a box portion 161 and the cover portion 163.

The box portion 161 is installed on or over the rear panel 110 to cover the circumference of the tub 120.

The cover portion 163 is coupled to a front surface of the box portion 161 and covers the front panel 130, and includes a door 165 installed at a position corresponding to the opening 132.

The cover portion 163 includes a manipulation unit 164 at the bottom thereof. The manipulation unit 164 has manipulation buttons, a figure display device, and the like, and is in communication with the control unit 133.

A detergent drawer or box 166 configured to contain detergent is detachably coupled to a detergent box opening 135, and the fabric conditioner drawer or box 167 configured to contain fabric conditioner is detachably coupled to a fabric conditioner box opening 137.

The water supply device 170 is coupled to the top of the rear panel 110, and supplies water into the tub 120.

In the present embodiment(s), the water supply device 170 includes a water supply device (not illustrated) and a water supply pipe (not illustrated). The water supply valve controls a flow rate of wash water supplied into the tub 120 through the water supply pipe.

A first side or end of the water supply valve is coupled to the top of the rear panel 110 and connects to the water supply pipe, and a second side or end of the water supply valve couples to the tub 120 to supply wash water received through the water supply pipe into the tub 120.

The water supply pipe is inserted into the circumference 112 from a water supply source outside the wall-mounted drum washing machine 100, and extends to the top of the rear panel 110 and connects to the water supply valve.

The drain device 175 discharges wash water from the tub 120 outside of the wall-mounted drum washing machine 100, or specifically, the outside of the cover 160 or the rear panel 110.

The drain device 175 in accordance with one or more embodiments includes a drain hole 176, a drain pump 177, and a drain pipe 178.

The drain hole 176 is at the bottom of the tub 120, and wash water in the tub 120 is discharged outside of the tub 120 through the drain hole 176.

The drain pump 177 is installed at the bottom of the tub 120 at a position corresponding to the drain hole 176.

The top of the drain pump 177 is coupled to the bottom of the tub 120 and communicates with the drain hole 176. A rear end of the drain pump 177 facing the rear panel 110 is connected to, continuous with or in communication with the drain pipe 178.

The drain pipe 178 is connected to, continuous with or in communication with the drain pump 177, and extends outside of the wall-mounted drum washing machine 100 through the rear panel 110.

When the drain pump 177 is operating, wash water within the tub 120 is forcibly discharged toward the drain pipe 178 through the drain hole 176. When the drain pump 177 is not operating, the wash water remains in the tub 120.

Figure 10:
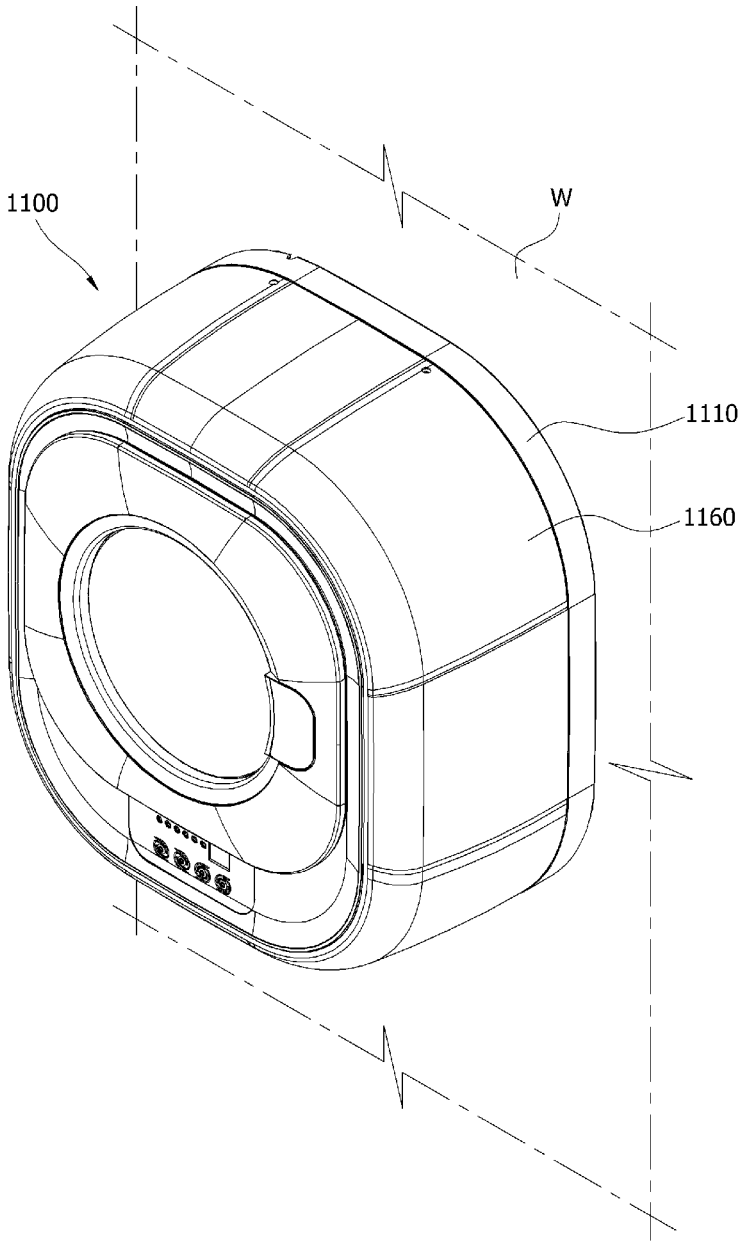
FIG. 10 is a perspective view illustrating an exemplary wall-mounted drum washing machine in accordance with one or more other embodiments of the present invention installed on a wall surface.
Figure 11:
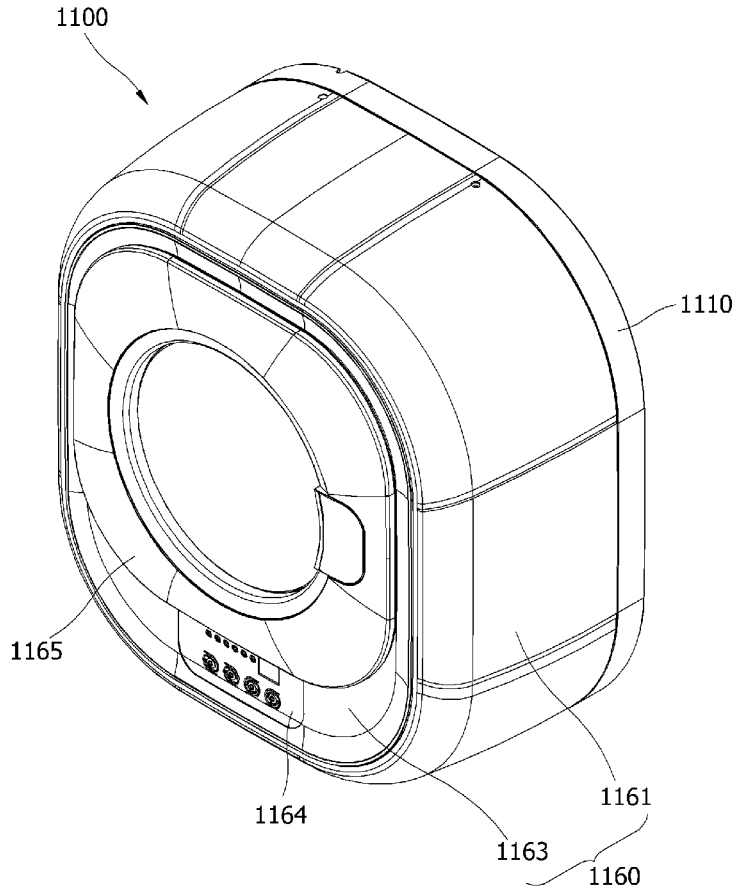
FIG. 11 is a front perspective view of the exemplary wall-mounted drum washing machine in accordance with embodiment(s) of the present invention.
Figure 12:
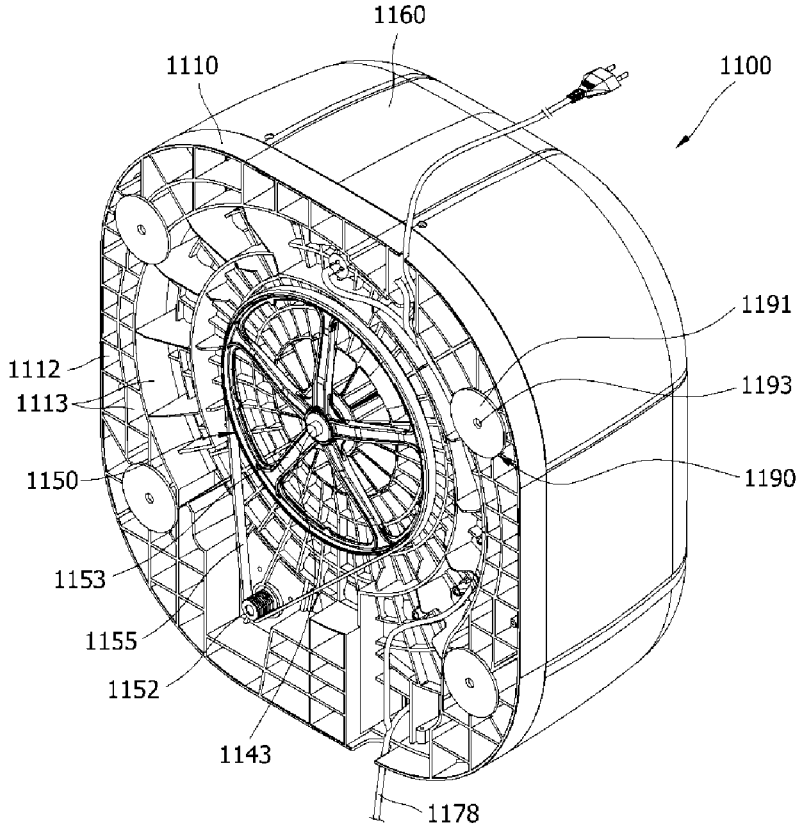
FIG. 12 is a rear perspective view of the exemplary wall-mounted drum washing machine in accordance with embodiment(s) of the present invention.
Figure 13:
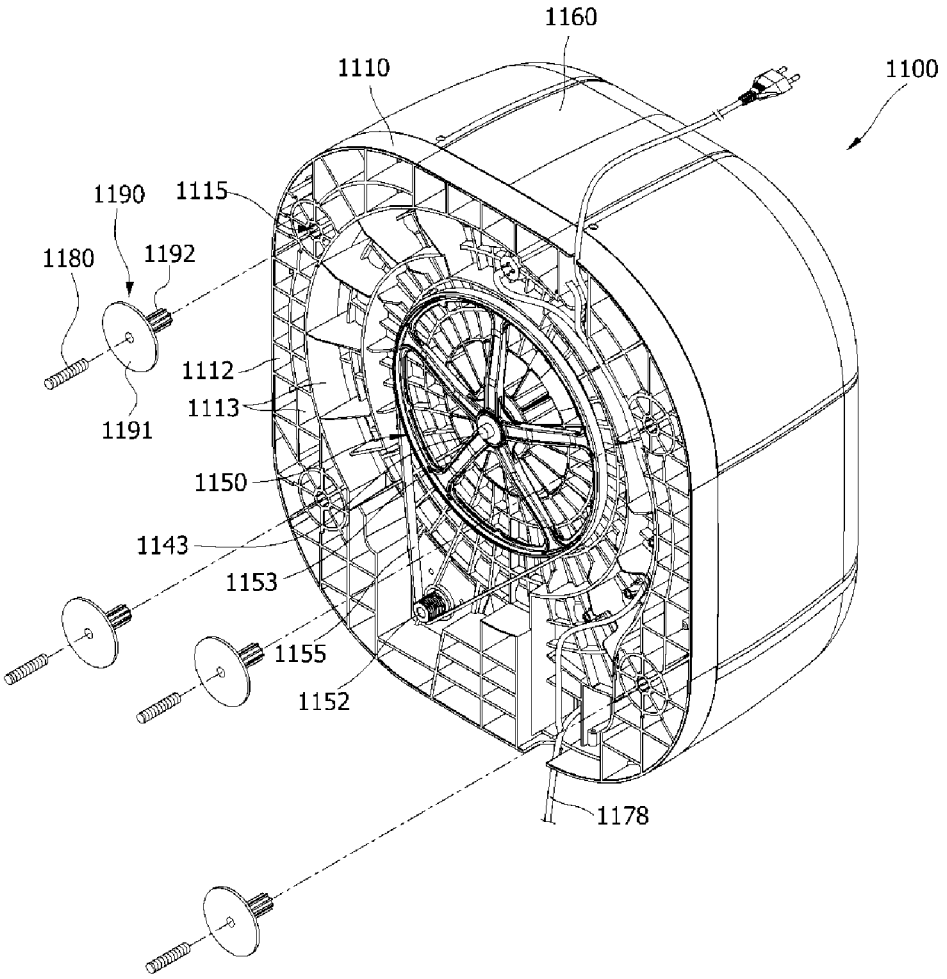
FIG. 13 is a perspective view illustrating exemplary buffers separated from a rear panel in the wall-mounted drum washing machine in accordance with embodiment(s) of the present invention.
Figure 14:
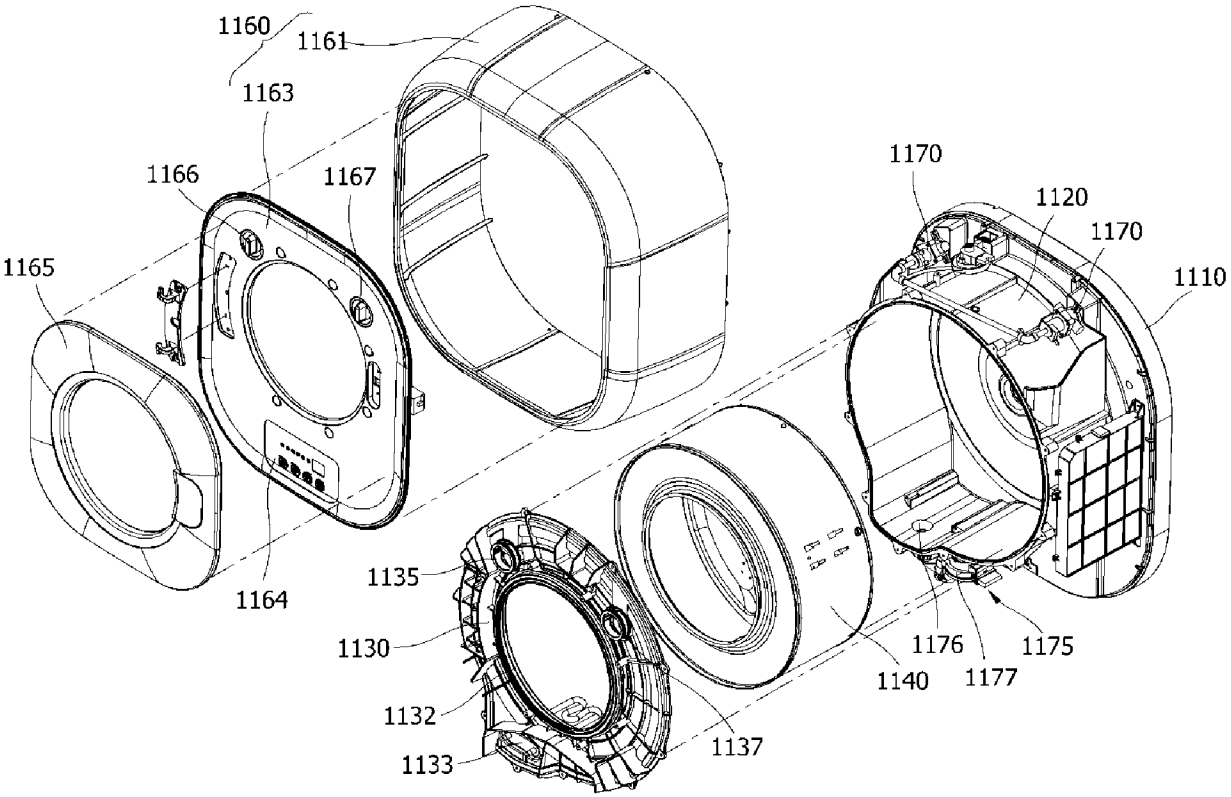
FIG. 14 is an exploded perspective view of the exemplary wall-mounted drum washing machine in accordance with embodiment(s) of the present invention.
Figure 15:
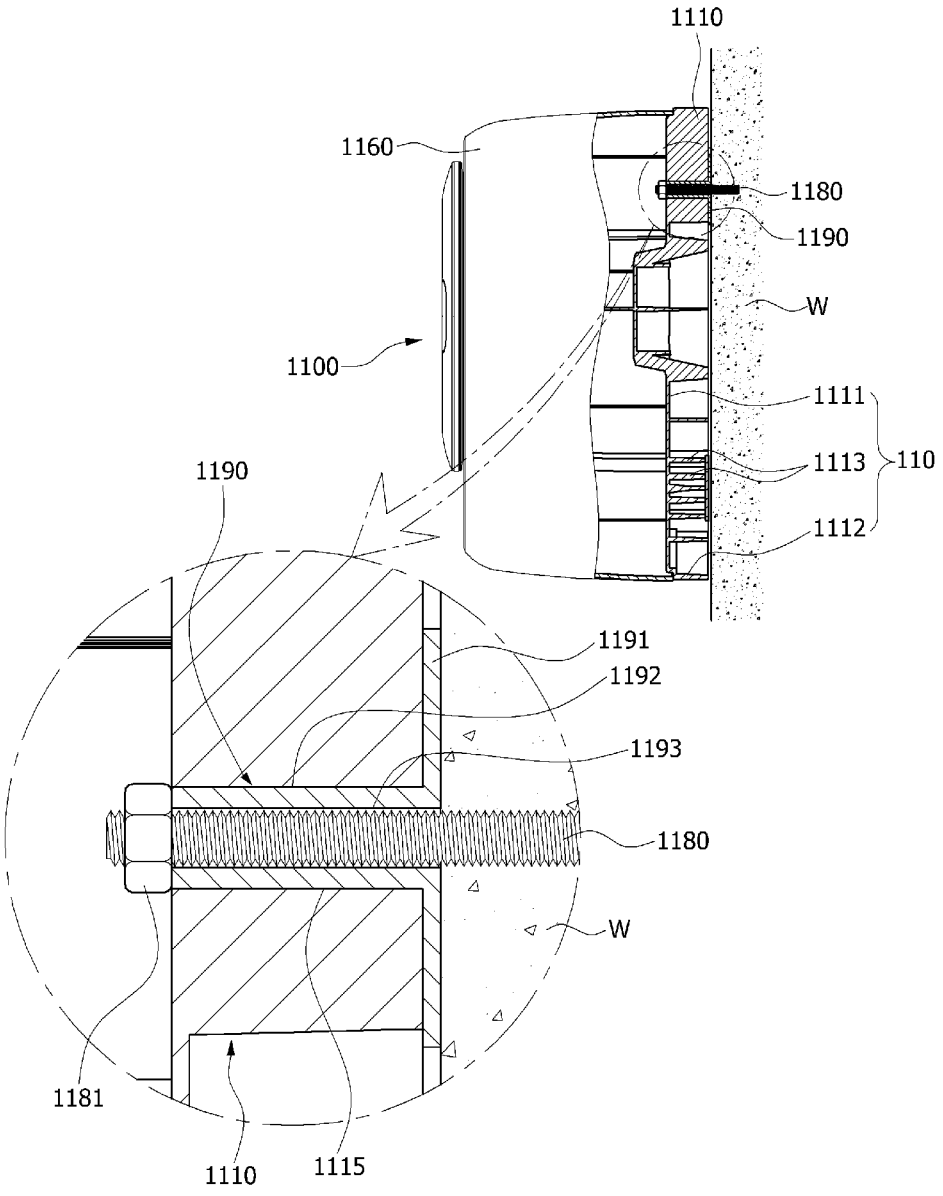
FIG. 15 is a partial side cross-sectional view of the exemplary wall-mounted drum washing machine in accordance with embodiment(s) of the present invention.
Figure 16:
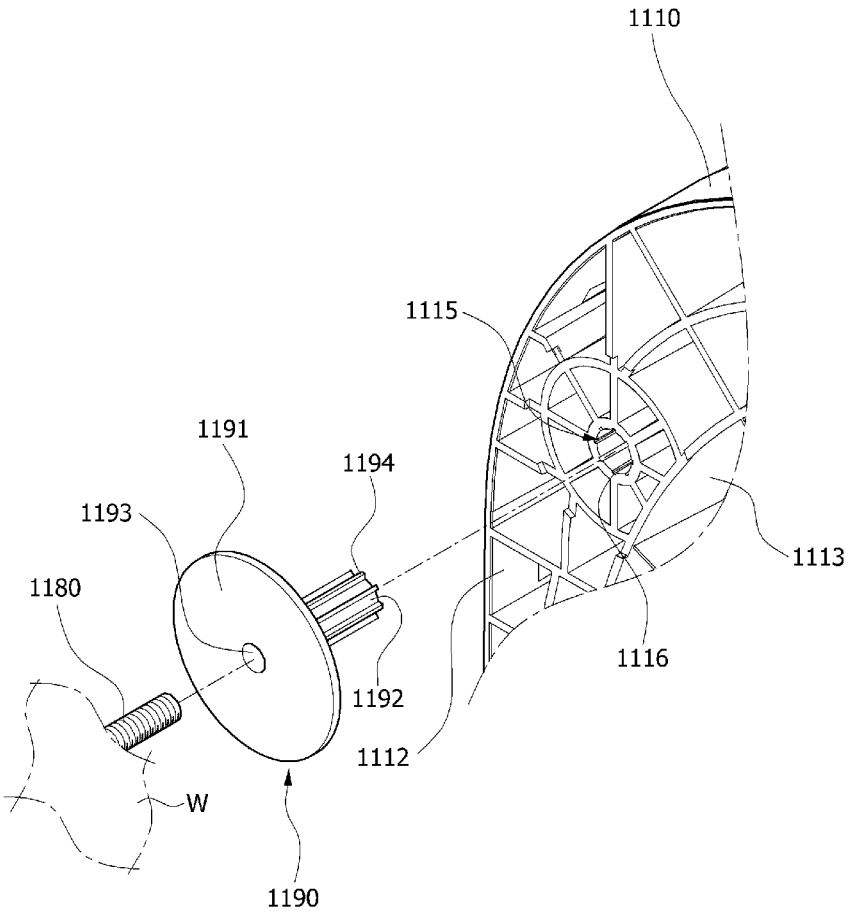
FIG. 16 is an exploded perspective view illustrating the exemplary rear panel, the exemplary buffer, and a fastening or fixing unit in the wall-mounted drum washing machine in accordance with embodiment(s) of the present invention.
Figure 17:
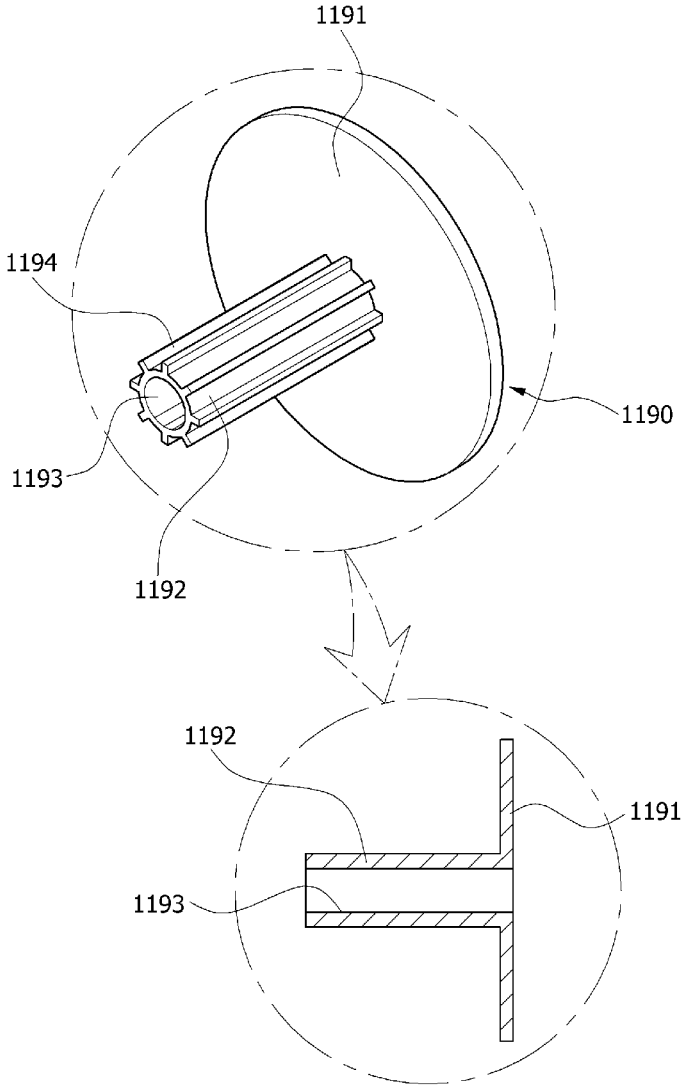
FIG. 17 is a cross-sectional view of the exemplary buffer for a wall-mounted drum washing machine in accordance with embodiment(s) of the present invention.
Figure 18:
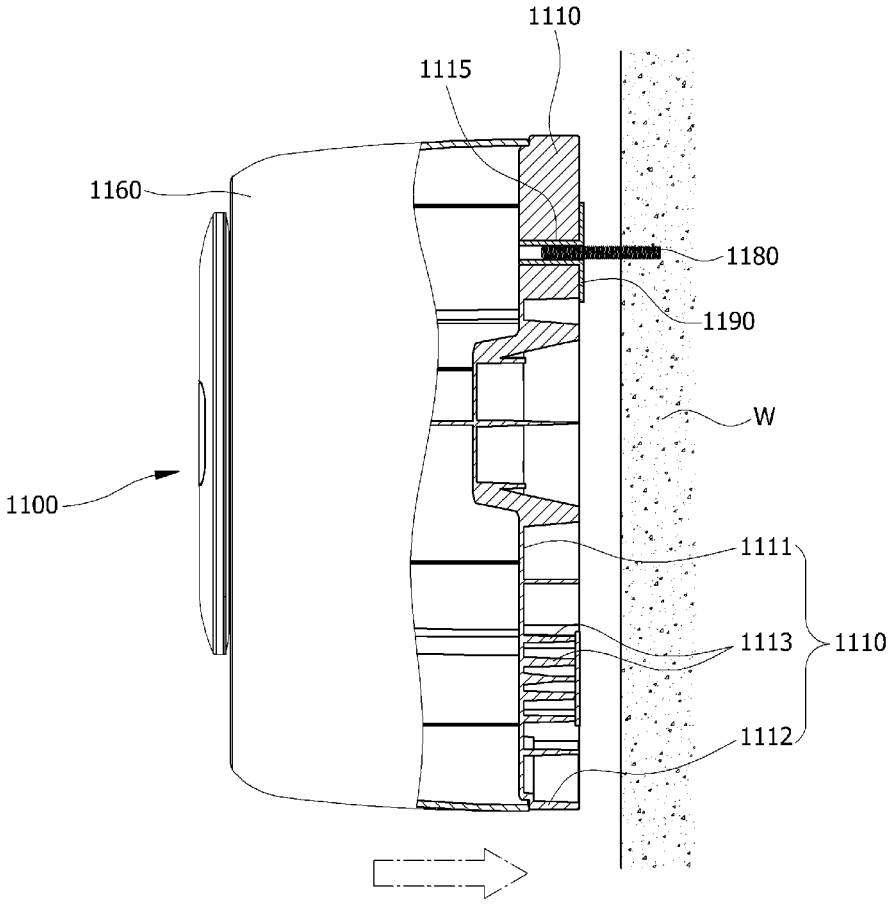
FIG. 18 is a diagram illustrating the exemplary rear panel positioned close to the fastening or fixing unit in the wall-mounted drum washing machine in accordance with embodiment(s) of the present invention.
Figure 19:
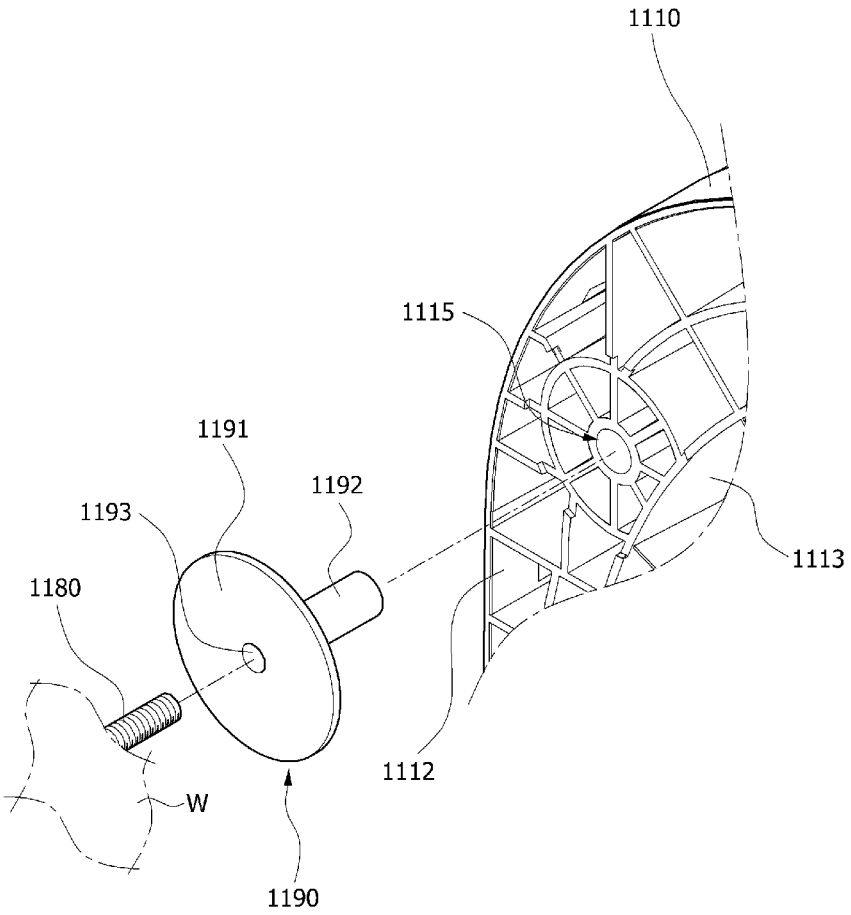
FIG. 19 is a perspective view of an exemplary modification of the buffer in accordance with embodiment(s) of the present invention.

FIG. 10 is a perspective view illustrating an exemplary wall-mounted drum washing machine in accordance with one or more other embodiments of the present invention on a wall surface. FIG. 11 is a front perspective view of the exemplary wall-mounted drum washing machine in accordance with embodiment(s) of the present invention. FIG. 12 is a rear perspective view of the exemplary wall-mounted drum washing machine in accordance with embodiment(s) of the present invention. FIG. 13 is a perspective view illustrating an exemplary buffer separated from a rear panel in the wall-mounted drum washing machine in accordance with embodiment(s) of the present invention. FIG. 14 is an exploded perspective view of the exemplary wall-mounted drum washing machine in accordance with embodiment(s) of the present invention. FIG. 15 is a partial side cross-sectional view of the exemplary wall-mounted drum washing machine in accordance with embodiment(s) of the present invention. FIG. 16 is an exploded perspective view illustrating the exemplary rear panel, the buffer, and a fastening or fixing unit in the wall-mounted drum washing machine in accordance with embodiment(s) of the present invention. FIG. 17 is a cross-sectional view of the exemplary buffer in the wall-mounted drum washing machine in accordance with embodiment(s) of the present invention. FIG. 18 is a diagram illustrating the exemplary rear panel positioned close to the fastening or fixing unit(s) in accordance with embodiment(s) of the present invention. FIG. 19 is a perspective view of an exemplary modification of the buffer in accordance with embodiment(s) of the present invention.

Referring to FIGS. 10-16, an exemplary wall-mounted drum washing machine 1100 in accordance with embodiment(s) of the present invention includes a rear panel 1110, a tub 1120, a front panel 1130, a drum 1140, a driving unit 1150, a cover 1160, a water supply device 1170, a drain device 1175, a fastening or fixing unit 1180, and a buffer 1190.

The rear panel 1110 has a panel shape and is attached to, or mounted, installed, or fixed on a wall surface W. In the present embodiment(s), the rear panel 1110 may be square or rectangular and may have rounded corners, but is not limited thereto. Thus, the rear panel 1110 may have one of various shapes, such as circular or elliptical.

The rear panel 1110 includes a panel portion 1111, a circumference 1112, and a plurality of ribs 1113.

The panel portion 1111 has a panel shape that extends parallel to the wall surface W.

The circumference 1112 protrudes or extends from the edge of the panel portion 1111 toward the wall surface W, forming a space between the panel portion 1111 and the wall surface W.

The ribs 1113 are on a rear surface of the panel portion 1111 in the space between the panel portion 1111 and the wall surface W.

Since the rear panel 1110 is reinforced by the ribs 1113, the rear panel 1110 may not be easily deformed or broken by vibrations generated from rotations of the drum 1140.

An exterior part of the wall-mounted drum washing machine 1100 may be referred to as a housing. Thus, the rear panel 1110 forming a rear surface, the cover 1160 forming side surfaces, and a front surface of the wall-mounted drum washing machine 1100 are collectively referred to as the housing.

In the present embodiment(s), the rear panel 1110 has a through-hole 1115 through which the fastening or fixing unit(s) 1180 is inserted and coupled to the wall W, and the buffer 1190 is inserted to block direct contact between the fastening or fixing unit(s) 1180 and the rear surface of the rear panel 1110.

The buffer 1190 is inserted into the through-hole 1115, and the buffer 1190 is between the wall surface W and the rear panel 1110 having the through-hole 1115 therein. The buffer 1190 has a buffered through-hole 1193 through which the fastening or fixing unit(s) 1180 are inserted. As a result, the fastening or fixing unit(s) 1180 pass through the through-hole 1115 when the fastening or fixing unit(s) 1180 are inserted into the buffered through-hole 1193 of the buffer 190.

The vibrations and noise generated during the washing operation of the wall-mounted drum washing machine 1100 are transmitted to the wall surface W through the rear panel 1110. As a result, the buffer 1190 between the rear panel 1110 and the wall surface W may significantly reduce the amount of vibrations and noise transmitted to the wall surface W.

Referring to FIGS. 16-19, the buffer 1190 includes a pad 1191 and one or more boss portions (e.g., protrusions or projections) 1192.

The pad 1191 is between the rear surface of the rear panel 1110 and the wall surface W. In the present embodiment(s), the pad 1191 has a circular shape and may be substantially planar, but is not limited thereto. Thus, the pad 1191 may have any of various shapes, such as a triangular or rectangular shape.

The boss portion 1192 protrudes or extends forward from the pad portion 1191. The boss portion 1192 has a hollow cylindrical shape, and the buffered through-hole 1193 is in the boss portion 1192. The outer surface of the boss portion 1192 has a shape corresponding to the inner surface of the through-hole 1115.

In one embodiment, the boss portion 1192 and the through-hole 1115 may have a circular cross-sectional shape (refer to FIG. 19). The outer diameter of the boss portion 1192 may be equal to the inner diameter of the through-hole 1115, and the outer surface of the boss portion 1192 may fit closely or tightly to the inner surface of the through-hole 1115.

As a result, there are no gaps between the boss portion 1192 and the through-hole 1115 when the boss portion 1192 is in the through-hole 1115. Therefore, it may be possible to block noise that may occur in the absence of the boss portion 1192 during the washing operations of the wall-mounted drum washing machine 1110.

In another embodiment, the boss portion 1192 has a plurality of protrusions or projections 1194 on the outer surface thereof, and the through-hole 1115 has a plurality of grooves 1116 in the inner surface thereof, having a shape corresponding to the protrusions or projections 1194 (refer to FIG. 16).

In the present embodiment(s), the protrusions or projections 1194 may have a rectangular cross-sectional shape, and the grooves 1116 may also have a rectangular cross-sectional shape. The shapes of the protrusions or projections 1194 and the grooves 1116 are not limited thereto, but may be modified into other shapes.

Since the protrusions or projections 1194 of the boss portion 1192 are received in the grooves 1116 of the through-hole 1115, the boss portion 1192 does not rotate in the through-hole 1115. Although vibrations occur when the wall-mounted drum washing machine 1100 is operated, the boss portion 1192 does not rotate in the through-hole 1115 due to the protrusions or projections 1194 in the grooves 1116.

Thus, it may be possible to fundamentally prevent the rotation of the fixing unit 1180 inserted into the buffered through-hole 1193, which may occur due to the rotation of the boss portion 1192. Therefore, it may be possible to prevent the separation of the fixing unit 1180 from the wall surface W or prevent a decrease in the fastening force of the fixing unit 1180.

The protrusions or projections 1194 may be at even intervals on the outer surface of the boss portion 1192. Thus, the grooves 1116 may be at corresponding positions of the inner surface of the through-hole 1115.

When the protrusions or projections 1194 and the grooves 1116 are at even intervals from each other, the boss portion 1192 and the through-hole 1115 may be at a precise position by matching one protrusion 1194 with one groove 1116 when the boss portion 1192 is in the through-hole 1115. Thus, the operator may easily insert the buffer 1190 into the through-hole 1115.

Furthermore, as the protrusions or projections 1194 of the boss portion 1192 may be symmetrical with respect to the center of the boss portion 1192, it may be possible to uniformly reduce vibrations that occur during washing operations of the wall-mounted drum washing machine 1100.

The buffered through-hole 1193 has a center aligned with the center of the boss portion 1192. Thus, the boss portion 1192 is between the through-hole 1115 and the fastening or fixing unit(s) 1180 installed through the boss portion 1192. More specifically, the buffered through-hole 1193 has a uniform thickness in every direction. Therefore, it may be possible to uniformly reduce vibrations that occur during the washing operation of the wall-mounted drum washing machine 1100.

The pad portion 1191 and the boss portion 1192 may be integrated with each other. In the present embodiment(s), the pad portion 1191 and the boss portion 1192 may comprise a rubber having an excellent shock absorption force.

Therefore, the vibrations and noise generated in the housing of the wall-mounted drum washing machine 1100 are absorbed by the buffer 1190 before the vibrations and noise are transmitted to the wall surface W.

A first side or end of the fixing unit(s) 1180 is attached to the wall surface W, and a second side or end of the fastening fixing unit(s) 1180 is inserted into the buffered through-hole 1193 of the buffer 1190. In the present embodiment(s), the rear panel 1110 may be square or rectangular, or have a panel shape similar to the rectangular shape when seen from the front, and may include four through-hole 1115 at four corners thereof. Thus, the wall-mounted drum washing machine 1110 may include four buffers 1190 inserted in the through-holes 1115 and four fixing units 1180 inserted in the buffered through-holes 1193 of the buffer 1190. However, the present invention is not limited thereto, and the wall-mounted drum washing machine 1110 may include three or less, or five or more, buffer units and fixing units.

Referring to FIGS. 15 and 16, the fastening or fixing unit(s) 1180 are coupled to the rear panel 1110 and pass through the buffered through-hole 1193 of the through-hole 1115. When an anchor bolt is applied as the fixing unit 1180, a nut member 1181 may be fastened to a front end of the fixing unit 1180, thereby stably and/or tightly fixing or attaching the rear panel 1110 to the wall W. The nut member 1181 is fastened to the fixing unit 1180 at the front of the rear panel 1110, and contacts the front surface of the rear panel 1110.

Referring to FIGS. 12 to 15, the tub 1120 is supported by the rear panel 1110, and is configured to contain wash water. In the present embodiment(s), the tub 1120 has a cylindrical shape, may be integral with the front surface of the rear panel 1110, and protrudes or extends forward from the front surface of the rear panel 1110.

The rotatable drum 1140 has a cylindrical shape, is in the tub 1120, and is configured to contain laundry items therein. The drum 1140 has a rotatable driving shaft 1143 installed through the rear panel 1110 and connected to a driving unit 1150 on the rear surface of the rear panel 1110.

The driving unit 1150 provides power to the drum 1140. The driving unit 1150 in accordance with embodiment(s) of the present invention includes a motor (not illustrated), a driving wheel 1153, and a belt 1155.

The motor is on the front surface of the rear panel 1110, and has a rotating shaft 1152 extended to the rear surface of the rear panel 1110 through the rear panel 1110.

The rotatable driving wheel 1153 is in the rear surface of the panel portion 1111 in the space at the rear of the panel portion 1111, and connected to the driving shaft 1143 of the drum 1140.

The belt 1155 transmits the power of the motor to the driving wheel 1153. The belt 1155 is around the rotating shaft 1152 of the motor at one end, and around the driving wheel 1153 at another end.

As the motor is driven, the torque of the motor is transmitted to the driving wheel 1153 through the belt 1155, and the drum 1140 connected to the driving wheel 1153 rotates to perform a washing operation.

The front panel 1130 has an opening 1132 at a position corresponding to an opening of the tub 1120, and is installed on the front surface of the tub 1120. The front panel 1130 includes a control unit 1133 installed at the bottom thereof, and has a detergent drawer opening 1135 and a fabric conditioner drawer opening 1137 installed at the top thereof.

The control unit 1133 is continuous with or in communication with a manipulation unit (e.g., an operation unit) 1164 in a cover portion 1163, and controls various processes, such as, supplying water, draining wash water, spin-drying, rotating the drum 1140, and the like according to the manipulation unit 1164.

The cover 1160 is on or over the rear panel 1110 and covering the tub 1120 and the front panel 1130, thereby forming the exterior of the wall-mounted drum washing machine 1100 in accordance with embodiment(s) of the present invention.

The cover 1160 in accordance with embodiment(s) of the present invention includes a box portion 1161 and the cover portion 1163.

The box portion 1161 is on or over the rear panel 1110 and covers the circumference of the tub 1120.

The cover portion 1163 is coupled to a front surface of the box portion 1161 which covers the front panel 1130, and includes a door 1165 at a position corresponding to the opening 1132.

The cover portion 1163 includes the manipulation unit 1164 at the bottom thereof that connects to the control unit 1133. The manipulation unit 1164 has manipulation buttons, a figure display device, and the like.

A detergent drawer or box 1166 containing detergent is detachably coupled to the detergent box installation hole 1135, and a fabric conditioner drawer or box 1167 containing fabric conditioner is detachably coupled to the fabric conditioner box installation hole 1137.

The water supply device 1170 is coupled to the top or upper surface of the rear panel 1110, and supplies water into the tub 1120.

In the present embodiment(s), the water supply device 1170 includes a water supply valve (not illustrated) and a water supply pipe (not illustrated). The water supply valve controls a flow rate of wash water supplied into the tub 1120 through the water supply pipe.

A first side or end of the water supply valve is coupled to the top or upper surface of the rear panel 1110 and connects to the water supply pipe, and a second side or end of the water supply valve is coupled to the tub 1120 and supplies wash water from the water supply pipe into the tub 1120.

The water supply pipe is inserted in the circumference 1112 from a water supply source outside the wall-mounted drum washing machine 1100, and extends to the top of the rear panel 1110 to connect the water supply valve.

The drain device 1175 discharges wash water from the tub 1120 outside of the washing machine 1100, or specifically, outside the cover 1160 and/or the rear panel 1110.

The drain device 1175 in accordance with the present embodiment includes a drain hole 1176, a drain pump 1177, and a drain pipe 1178.

The drain hole 1176 is at the bottom or lowermost part of the tub 1120, and wash water within the tub 1120 is discharged outside of the tub 1120 through the drain hole 1176.

The drain pump 1177 is at the bottom or lowermost part of the tub 1120 at a position corresponding to the drain hole 1176.

The top of the drain pump 1177 is coupled to the bottom of the tub 1120 to communicate with the drain hole 1176, and a bottom or lowermost part of the drain pump 1177 (e.g., facing the rear panel 1110) is in communication with the drain pipe 1178.

The drain pipe 1178 is in communication with the drain pump 1177, and extends outside of the washing machine 1100 through the rear panel 1110.

When the drain pump 1177 is operating, wash water within the tub 1120 is discharged toward the drain pipe 1178 through the drain hole 1176, and when the drain pump 1177 is not operating, the wash water remains in the tub.

In accordance with the embodiments of the present invention, the guide has a larger size than the insertion opening. Thus, when the housing of the wall-mounted drum washing machine attaches to the fixing unit, the fixing unit is easily inserted in the insertion opening through the guide.

Furthermore, since the guide has a cross-sectional area which decreases from the rear surface of the housing toward the front side of the housing, the fastening or fixing unit(s) may be inserted in the insertion opening by approximating the distance between of the housing and the fixing unit, as long as the fixing unit contacts the guide. Thus, the fixing unit and the housing may be precisely connected to each other.

Furthermore, as the buffer is configured to be between the wall surface and the rear surface of the housing of the wall-mounted drum washing machine, it may be possible to prevent the vibrations and noise generated during the washing operation from being transmitted to the wall surface.

Furthermore, since the buffer is configured to be between the wall surface and the rear surface of the housing, it may be possible to prevent vibrations and noise generated during the washing operation from being transmitted to the wall surface.

Furthermore, since the buffer is between the rear surface of the housing and the fastening or fixing unit(s) that passes through the rear surface of the housing, it may be possible to fundamentally block noise that may occur when the rear surface of the housing contacts the fastening or fixing unit(s).

The embodiments of the present invention have been disclosed above for illustrative purposes. Those skilled in the art will appreciate that various modifications, additions and substitutions are possible, without departing from the scope and spirit of the invention as disclosed in the accompanying claims.

What is claimed is:

1. A wall-mounted drum washing machine comprising:

a housing having one or more through-holes in a rear surface thereof;

a tub disposed within the housing and configured to contain water;

a rotatable drum disposed within the tub and configured to contain laundry items;

one or more buffers respectively inserted in the one or more through-holes and arranged between the rear surface and a surface of a wall, each buffer having one or more boss portions; and one or more fastening or fixing units having a first side or end configured to be inserted to be coupled to the wall and a second side or end inserted through one of the one or more through-holes, wherein each of the one or more fastening or fixing units includes a threaded outer surface and a nut member is screwed to the second side or end of the one or more fastening or fixing units, wherein said each buffer includes a buffer through-hole and each of the one or more fastening or fixing units is configured to pass through the buffer through-hole, wherein each of the one or more boss portions has a plurality of protrusions or projections on the outer surface thereof, and each of the one or more through-holes has a plurality of grooves in the inner surface thereof, the plurality of grooves having a shape corresponding to the plurality of protrusions or projections, wherein the plurality of protrusions or projections of the one or more boss portions are extended along a direction in which the one or more buffers are inserted in the one or more through-holes, and wherein the plurality of protrusions or projections of the one or more boss portions are received in the plurality of the grooves of the one or more through-holes, so that the one or more boss portions prevent a rotation in a clockwise direction and a counter clockwise direction within the one or more through-holes.

2. The wall-mounted drum washing machine of claim 1, wherein said each buffer comprises:

a pad between the rear surface and the wall surface; and the one or more boss portions are configured to protrude or extend from the pad.

3. The wall-mounted drum washing machine of claim 2, wherein the outer surface of the one or more boss portions matches or mates with the inner surface of the one or more through-holes.

4. The wall-mounted drum washing machine of claim 3, wherein an outer diameter of the one or more boss portions is equal to an inner diameter of the one or more through-holes.

5. The wall-mounted drum washing machine of claim 2, wherein the buffer through-hole is at or in a center of each of the one or more boss portions.

* * * * *